United States Patent [19]

McDonald et al.

[11] 4,453,321

[45] Jun. 12, 1984

[54] EXTRUSION COOLING APPARATUS

[75] Inventors: Howard L. McDonald, Grand Rapids, Mich.; Richard P. Petri, Phillips, Wis.

[73] Assignee: Industrial Air Products, Inc., Phillips, Wis.

[21] Appl. No.: 328,404

[22] Filed: Dec. 7, 1981

[51] Int. Cl.[3] ..... F26B 15/12

[52] U.S. Cl. ..... 34/182; 34/229; 72/257

[58] Field of Search ..... 72/201, 257; 34/20, 34/182, 57 C, 57 A, 222, 229, 216, 217, 67

[56] References Cited

U.S. PATENT DOCUMENTS

| | | | |
|---|---|---|---|
| 3,010,218 | 11/1961 | Sylvest | 34/182 |
| 3,371,430 | 3/1968 | Bowman | 34/217 |
| 4,068,516 | 1/1978 | Wonisch | 72/201 |
| 4,362,040 | 12/1982 | Yamaguchi et al. | 72/201 |

*Primary Examiner*—Larry I. Schwartz

*Attorney, Agent, or Firm*—Andrus, Sceales, Starke & Sawall

[57] ABSTRACT

An extrusion apparatus includes a slot-type cooling table over which elongated extruded members move laterally. A plurality of side-by-side blower units are located beneath the table to develop a blanket of air through which the aluminum extruded members pass. Each unit includes a motor-driven tubular air blower having a tubular outlet duct. A rectangular discharge nozzle is connected to the air blower and spans the extrusion line and also extends along a predetermined length of the extrusion conveyor. A plurality of adjustable louvers are connected within the nozzle to uniformly disperse the air from the tubular outlet duct into a square uniform curtain of air which passes upwardly over the conveying line and the metal extruded member on the conveyor. The louvers direct the air directly perpendicular to the extrusion and/or partially on-line with the hot extrusion. This produces high quality, uniform characteristic in the aluminum extruded member.

10 Claims, 6 Drawing Figures

EXTRUSION COOLING APPARATUS

BACKGROUND OF THE PRESENT INVENTION

This invention relates to a forced air extrusion cooling apparatus and is particularly adapted for cooling elongated hot aluminum extruded members or other similar hot extruded members.

In modern manufacture of elements from aluminum, copper, plastic and the like, extrusion apparatus is often used to form an elongated extruded member. The extrusion apparatus may include a single die or a series of side-by-side heated die through which the molten or plastic aluminum or other material is forced under pressure. The extruded member is pulled or carried from the extrusion heated die as a continuous, long member for subsequent processing. The pressure, temperatures and the like are of course related to the particular materials and the particular extrusion process. Generally, the hot extruded member is reasonably self-supporting, and may be carried from the die or deposited onto a suitable conveyor means which carries the elongated extruded member from the extrusion die. The elongated member is then transferred to another working station. For example, an aluminum extruded I-Beam may be transferred to a stretching machine which stretches the extruded member. Forced cooling of the extruded member is often provided by suitable air blowers in order to protect and properly condition the metal for subsequent handling and processing. For example, a plurality of more tubular axial flow fans may be mounted beneath the transfer conveyor for moving the extruded I-Beam members to the stretching machine. Although such air fan apparatus is widely used, difficulty has been encountered in maintaining and producing high quality, uniform characteristics in the aluminum extruded member because of the flow pattern. Apparently small variation in the air cooling flow may change the characteristic of the aluminum extruded member throughout the length of the extruded element. If the metal characteristic of the metal in the extruded member is not uniform, the metal element is distorted or fails in the stretching apparatus.

SUMMARY OF THE PRESENT INVENTION

The present invention is particularly directed to a forced air source for developing a blanket of air which is forced over the aluminum extrusion in a uniform, consistent manner. The present invention thus produces a high quality, uniform characteristic in metal extruded member, such as an aluminum extruded member. Generally in accordance with the present invention, a motor-driven tubular air blower is provided having a conventional tubular outlet duct. The blower is located beneath the extrusion conveyor means. A special discharge nozzle unit is coupled to the discharged end of the outlet duct. The discharge nozzle unit includes a generally rectangular discharge nozzle which spans the extrusion line and which also extends along a predetermined length of the extrusion conveyor. The discharge nozzle is provided with adjustable louvers to uniformly disperse the air from outlet duct through the discharge nozzle as a uniform blanket or curtain of air which passes upwardly over the conveying line and therefore over the metal extruded member on the conveyor. The louvers are formed as an adjustable elongated blade extended along the path of the extrusions to permit direction of the air. Thus, the air may be directed perpendicular to the extrusion or partially on-line with or across the hot extrusion to establish a continuous uniform blanket or curtain. Thus, a plurality of the air cooling fan apparatus mounted in side-by-side relation can be readily arranged to produce overlapping air flows to develop a continuous, rectangular air curtain to fully and similarly all portions of the extruded member.

The present invention has been found to produce a simple economical and reliable air cooling means for producing and creating high quality elongated extrusions.

DESCRIPTION OF THE DRAWING FIGURES

The drawing furnished herewith illustrates a preferred construction of the present invention in which the above advantages and features are clearly disclosed as well as others which will be readily understood from the following description.

DESCRIPTION OF THE ILLUSTRATED EMBODIMENT

Figure 1:
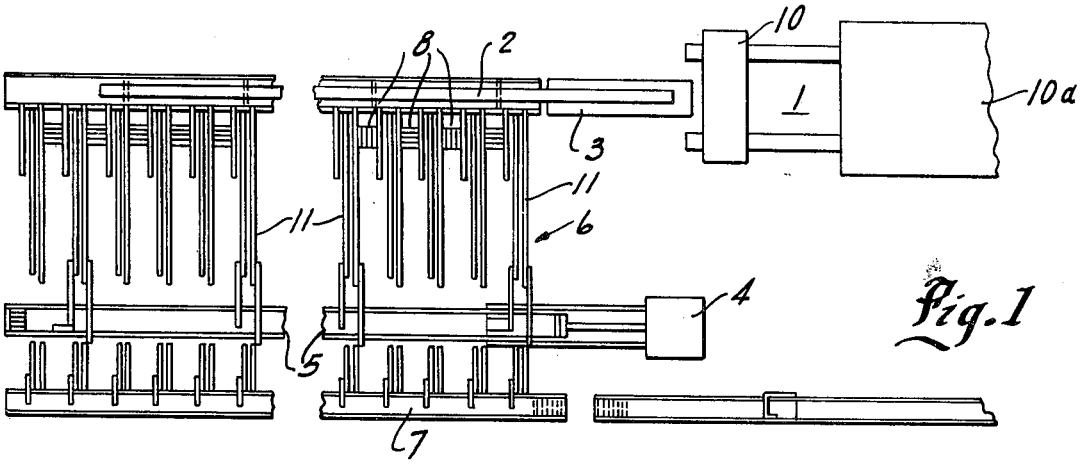
FIG. 1 is a plan view of an extrusion apparatus incorporating the subject matter of the present invention.
Figure 2:
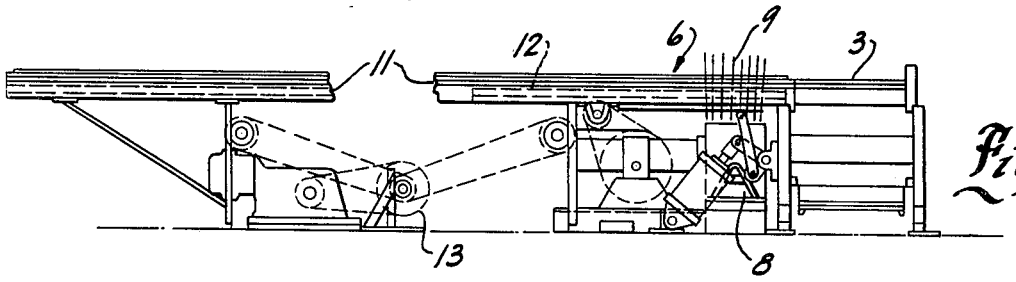
FIG. 2 is a side elevational view of the extrusion apparatus shown in FIG. 1.
Figure 3:
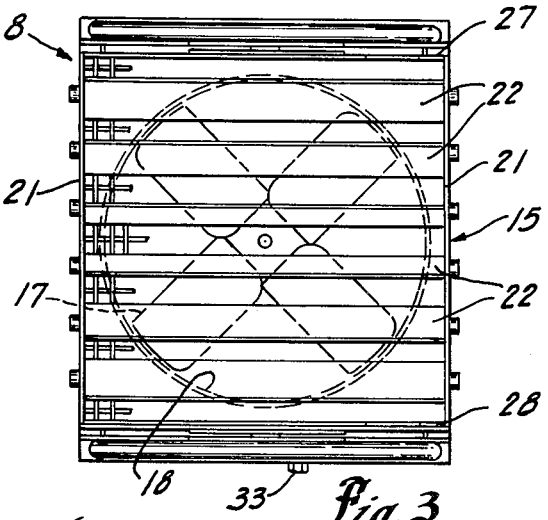
FIG. 3 is an enlarged plan view of the air cooling apparatus shown in FIGS. 1 and 2.
Figure 4:
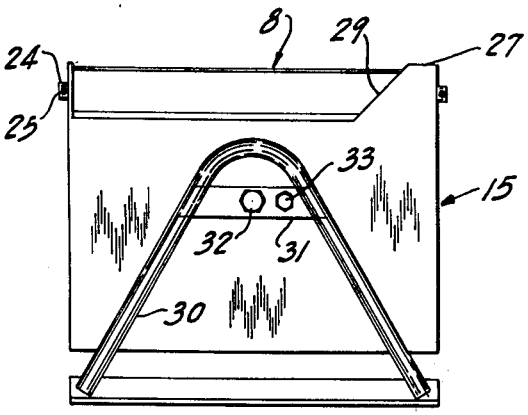
FIG. 4 is a side elevational view of FIG. 3.
Figure 5:
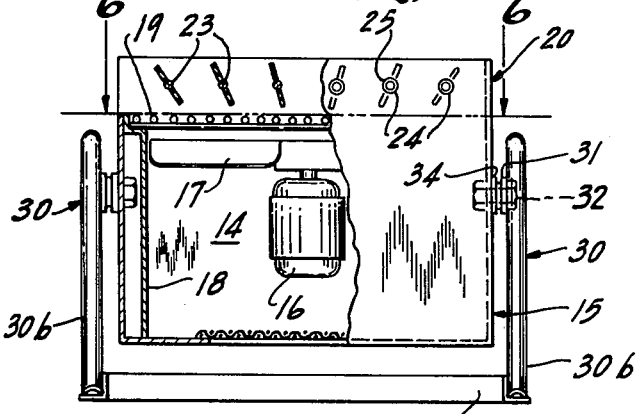
FIG. 5 is a different side elevational view of FIG. 3, with parts broken away and sectioned.
Figure 6:
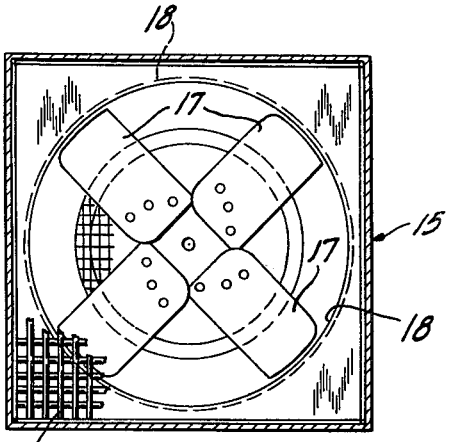
FIG. 6 is a horizontal section taken generally on line 6—6 of FIG. 5.

Referring to the drawing and particularly to FIG. 1, an extrusion apparatus 1 is illustrated for generating one or more side-by-side, elongated, beam extrusions 2. A runout conveyor 3 is located adjacent to the extrusion apparatus 1 and operates to transport the continuously formed extrusions 2 from the extrusion apparatus 1 for subsequent processing, such as in a stretcher unit 4. The stretcher unit 4 includes a stretching table 5 which is located parallel to the runout conveyor 3 and is coupled thereto by a walking beam cooling table conveyor 6. The stretched extrusions are transferred from the unit 4 to a storage table 7 for subsequent processing. The extrusions 2 as they come from the extrusion apparatus 1 are at an elevated temperature. Air blower units 8, which are specially constructed in accordance with the teaching of the present invention, are located beneath the cooling table conveyor 6 immediatedly adjacent to the runout conveyor 3 of the extrusion apparatus 1. As shown in FIG. 1, a series of separate side-by-side air blower units 8 are located in spaced relation beneath the cooling table conveyor 6. Each air blower unit 8 establishes an upwardly flowing air stream which is combined with that of the adjacent unit to form a curtain 9 of air which moves upwardly through the conveyor 6 and over the individual extrusions 2. Each source 8 for air curtain 9 is specially constructed to produce a rectangular shaped curtain which extends uniformly across the conveyor 6 and uniformly in the line or path of the extruded member for a short length of the conveyor 6. The air blower unit 8 is controlled to provide a constant air flow. The extrusions 2 thus pass through the air curtain 9 and are subjected to a uniform cooling.

The extrusion apparatus 1, as well as the several conveyors, may be any well known apparatus, or of other suitable construction, and are only diagrammatically illustrated and briefly described. For example, the several elements including the conveyor units are shown in the drawing generally of a type manufactured and sold by Granco-Clark of Belding, Michigan.

More particularly, the illustrated extrusion apparatus 1 includes a bulk supply of metal 1, such as aluminum. A die 10 is mounted at the infeed end of the runout conveyor 3. The die 10 is heated from any suitable heat source and a press 10*a* forces and extrudes the plastic metal through the die 10 at the elevated temperature. The die 10 shapes the metal into a continuously discharging elongated extrusion of the desired configuration, such as an I-Beam member 2.

Similarly, the runout conveyor 3 may be of any suitable open construction, such as a flat-type unit having intermeshed pivotally mounted lifting transfer members for transferring the full extrusion on the cooling table conveyor 6. The illustrated cooling table conveyor is shown as a well known walking-beam conveyor of the slot type. The conveyor defines an open supporting surface which is sufficient to support the elongated extruded members 2 from the extrusion runout conveyor 3. The open construction of the walking-beam cooling conveyor 6 permits the transfer and creation of the air flow curtain 9 from the plurality of blower units 8 mounted below the conveyor 6.

As noted previously, a uniform cooling of the extrusions 2 is significant, and the present invention is particularly directed to an improved, low cost blower construction for continuous and uniform cooling of the extrusions. The walking beam table conveyor 6 thus includes a series of parallel support beams 11 mounted in lateral spaced relation. Transfer beams 12 are movably mounted adjacent beams 11 and are coupled with eccentric coupling to a drive unit 13. The beams 12 are thus adapted to move upwardly and forwardly toward the stretching table 7 and then downwardly and rearwardly into the cooling table conveyor 6. The extruded members 2 on the outer end of the conveyor is thereby placed on the stretching table 7 for stretching by the stretcher unit 4, in accordance with known operations and handling. The cooling table conveyor 6 is used to provide adequate cooling of the extruded member 2 before stretching. Generally, to establish proper cooling, the extruded member 2 is force cooled on the initial portion of the conveyor 6 by the air curtains 9 created by the series of air blower units 8.

In the illustrated embodiment of the invention each air blower unit 8 includes a centrifugal fan 14 mounted within a special housing 15. The fan 14 is of the type used in various applications requiring a substantially constant air flow, and which has been heretofore used with extrusion cooling tables. The fan 14 includes an electric motor 16 for driving of a centrifugal fan wheel 17. The fan wheel 17 is rotatably mounted in a circular housing or duct 18 and establishes an upwardly directed circular airstream. The outer face of the blower duct 18 may be covered with the usual protective opened mesh 19. In accordance with the present invention, an air nozzle unit 20 is secured overlying the duct 18 at the discharge end of the fan 14, and shown as an integral part of housing 15. The housing 15 is a square housing which extends downwardly below the fan 14. The width of housing 15 essentially corresponds to the diameter of the fan duct 18 and projects to upwardly therefrom to form the nozzle unit 20.

The nozzle unit 20 thus includes a first pair of parallel side walls 21 projecting upwardly immediately contiguous to the maximum opening of the air blower duct 18.

A plurality of parallel louvers 22 are mounted between the side walls 21. Each of the louvers 22 is pivotally mounted as by pivot shafts 23 secured to the ends of the louvers and journaled in an opening and collar 24 secured to the extrusion of the side walls 21. The louvers may be manually set in any desired position, and are held in the set position in any suitable manner. In the illustrated embodiment, the collars are provided with setscrews 25 for locking the shaft 23 and therefore the louvers 22 in position. The louvers 22 are uniformly spaced between the opposite side or end walls.

The opposite side or end walls which extend parallel to the louvers 22 are removed except for a short end walls 27 and 28 immediately adjacent to the one side wall 21. The open ends permit extrusion of the air pattern and enlargement of the rectangular pattern for overlap of the individual air curtains. The retained walls 27 and 28 have a depth generally corresponding to the depth of the louvers 22 and are generally triangular in shape. Thus, each wall 27 and 28 includes an inclined side edge 29 to a very short top edge to define a minimal interference with the air flow pattern while strengthening the housing.

The housing 15 is pivotally supported in a cradle 30. The cradle 30 is illustrated as an open frame-type having a rectangular bottom frame 30*a* with a pair of inverted U-shaped side arms or walls 30*b* to the opposite sides of housing 15. A bearing bracket or plate 31 is secured to the upper end of the U-shaped side wall or cradle 30. A bearing shaft or pin 32 is connected to the housing and pivotally supported in a bearing in the bracket 31. The housing 15 may be tilted up to 20 degrees in either of the directions in line with the flow of the extrusions or the conveyor 6.

A locking bolt 33 is shown threaded through the bearing bracket 31 and may be threaded into engagement with an apertured plate 34 on the side wall of the housing 15 to lock the housing 15 in a tilted position.

The louvers 22 are thus individually adjustable for establishing precisely located air curtains which move upwardly over the path of the extrusions 2. The air curtain 9 is accurately adjusted to develop a narrow rectangular strip pattern or a substantially wider rectangular air pattern.

The inventor has found that the illustrated cooling fan apparatus permits the creation of a uniform air curtain over the cooling area to maintain optimum air cooling of the extrusions. This is in sharp contrast to the conventional round fans which create an uneven air flow with a substantially stronger air flow in the central area. Thus, the typical circular fan unit tends to create an uneven temperature within the extruded member, resulting in varying metallurgical values in the metal. When applied to the stretching apparatus, significant uneven stretching can be created with a resulting faulty product.

Although the louvers can be individually adjusted for any desire uniform air flow pattern with respect to the movement of the extrusions, it has generally been found that most satisfactorily cooling characteristics are obtained by adjusting the louvers to develop a controlled air pattern including a lateral extension so as to form a continuous, uniform air curtain. This particularly avoids the creation of dead air pockets, such as created in the removal corner portions of the tubular axial air flow fans.

The present invention has been found to provide a commercial adaptation of an air cooling means for aluminum and similar extrusions apparatus employing axial flow fans devices. The present invention is uniquely adapted to a creation of a consistent product of a superior quality when applied to metal and like extrusion systems, which require cooling of the extrusion.

Various modes in carrying out the invention are contemplated as being within the scope of the following claims, particularly pointing out and distinctly claiming the subject matter which is regarded as the invention.

We claim:

1. An extrusion cooling apparatus adapted to form a part of a continuous extrusion apparatus for producing an elongated hot extruded member, comprising an elongated support adapted to be located within a conveying means for the hot extruded member, an axial flow fan unit mounted to said support and having a circular output duct for developing a circular pattern of air moving upwardly from the fan unit, said output duct having a diameter substantially less than the length of said support, a substantially rectangular nozzle means and substantially the size of said duct secured to said duct in overlying relation to said fan unit and having a length substantially less than the length of said support to develop a rectangular air curtain from said circular pattern of air, said rectangular air curtain moving upwardly over a small length of the hot extruded member on said support, and a plurality of parallel louver means adjustably mounted within said nozzle means for controlling the size and direction of said rectangular air curtain.

2. The apparatus of claim 1 including pivotal support means connected to said fan unit and said support for tilting of the fan unit in opposite directions on-line with the flow of the extruded member.

3. The apparatus of claim 1 or 2 wherein said louvers are individually and separately adjustable.

4. The extrusion cooling apparatus of claim 2 including a rectangular housing enclosing said fan unit and being pivotally mounted to said support for tilting movement in opposite directions through the axis of said support means, said nozzle means having four side walls integrally formed with said housing.

5. The apparatus of claim 4 wherein the side walls parallel to said louvers are partial walls substantially less than the width of the housing and adjacent one end of the side wall.

6. In an extrusion conveying apparatus including a walking beam cooling table conveyor and an air flow unit mounted below said conveyor adjacent the infeed end of the conveyor comprising a base support having a pair of parallel upstanding support means, a rectangular housing located between said support means and pivotally mounted thereto for tilting movement in opposite directions through the axis of said support means, said rectangular housing having a width substantially spanning the conveyor and a length substantially less than the conveyor, an axial fan unit mounted within the lower end of said housing and discharging a circular flow of air upwardly through said rectangular housing, a plurality of adjustable louvers extending between the side walls of the housing above said fan unit, said louvers being individually pivotally mounted to said side walls, said parallel louvers extending normal to the axis of said pivot support means.

7. The apparatus of claim 6 including second side walls of said nozzle means parallel to said louvers, said second side walls being substantially open throughout the length of the nozzle and including a partial wall adjacent one said first side walls.

8. The apparatus of claim 6 or 7 wherein said louvers are equally spaced throughout the length of the housing.

9. The apparatus of claim 7 wherein said housing is square and with each side wall substantially twenty-six inches long, said partial end walls restricting the end discharge of air.

10. The apparatus of claim 7 wherein said louvers are set to a rectangular air pattern extending outwardly of the rectangular housing.

* * * * *

UNITED STATES PATENT AND TRADEMARK OFFICE

CERTIFICATE OF CORRECTION

PATENT NO. : 4,453,321

DATED : JUNE 12, 1984

INVENTOR(S) : HOWARD L. MCDONALD and RICHARD P. PETRI

It is certified that error appears in the above-identified patent and that said Letters Patent is hereby corrected as shown below:

Col. 5, line 37, Claim 2, delete "on-line" and substitute therefor ---in-line---.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*